US008616019B2

(12) United States Patent
Van Meter et al.

(10) Patent No.: US 8,616,019 B2
(45) **Date of Patent: *Dec. 31, 2013**

(54) REFRIGERATOR WITH INTERMEDIATE TEMPERATURE ICEMAKING COMPARTMENT

(75) Inventors: Kyle B. Van Meter, Coralville, IA (US); Dean A. Martin, Solon, IA (US); Xiaoyong Fu, Plano, TX (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/349,629

(22) Filed: Jan. 13, 2012

(65) Prior Publication Data

US 2012/0111047 A1 May 10, 2012

Related U.S. Application Data

(63) Continuation of application No. 12/254,218, filed on Oct. 20, 2008, now Pat. No. 8,117,863, which is a continuation of application No. 11/777,323, filed on Jul. 13, 2007, now Pat. No. 7,458,229, which is a continuation of application No. 11/131,701, filed on May 18, 2005, now Pat. No. 7,284,390.

(51) Int. Cl.
*F25C 5/18* (2006.01)

(52) U.S. Cl.
USPC ..... 62/344; 62/426

(58) Field of Classification Search
USPC ..... 62/340, 344, 414, 419, 426
See application file for complete search history.

(56) References Cited

U.S. PATENT DOCUMENTS

| | | | | |
|---|---|---|---|---|
| 5,272,888 | A * | 12/1993 | Fisher et al. | 62/344 |
| 6,735,959 | B1 * | 5/2004 | Najewicz | 62/3.63 |
| 6,945,068 | B2 * | 9/2005 | Kim et al. | 62/353 |
| 2005/0061016 | A1 * | 3/2005 | Lee et al. | 62/340 |

* cited by examiner

*Primary Examiner* — Mohammad M Ali

(57) ABSTRACT

An icemaking compartment is provided in the refrigerator compartment of a bottom mount refrigerator. An icemaker is within the icemaking compartment. A cold air duct supplies cold air from the freezer compartment to the icemaker. The cold air duct is formed in the rear wall of the refrigerator. A fan controls the flow of air through the cold air duct. A return air duct is provided to direct a portion of the air from the icemaker back to the freezer compartment. An air vent in the icemaker directs another portion of air into the refrigerator compartment.

19 Claims, 7 Drawing Sheets

REFRIGERATOR WITH INTERMEDIATE TEMPERATURE ICEMAKING COMPARTMENT

CROSS-REFERENCE TO RELATED APPLICATIONS

This application is a Continuation of U.S. application Ser. No. 12/254,218, which is a Continuation of U.S. application Ser. No. 11/777,323 filed Jul. 13, 2007, which is a Continuation of U.S. application Ser. No. 11/131,701 filed May 18, 2005, and which applications are hereby incorporated by reference in their entirety.

BACKGROUND OF THE INVENTION

Household refrigerators generally come in three structural styles: (1) a side-by-side model wherein the freezer and refrigerator compartments are side by side; (2) a top mount model wherein the freezer compartment is located above the refrigerator compartment; and (3) a bottom mount model wherein the freezer compartment is mounted below the refrigerator compartment. An icemaker is normally provided in the freezer compartment of all three models. A door mounted ice dispenser is often provided in a side-by-side refrigerator and in a top mount refrigerator so that a person can add ice to a glass without opening the freezer or refrigerator door. However, a door mounted ice dispenser normally is not been provided in bottom mount refrigerators, since the freezer door is too low, and there are difficulties in transporting ice from the freezer compartment to the refrigerator compartment which precludes a dispenser in the refrigerator compartment door. However, it is desirable to have an ice dispenser in the refrigerator compartment of a bottom mount refrigerator.

U.S. Pat. No. 6,735,959 issued to Najewicz discloses a thermoelectric icemaker placed within the fresh food compartment of a bottom mount refrigerator that may be dispensed through the fresh food door. Najewicz forms ice within the fresh food compartment using the thermoelectric icemaker even though the compartment is above a freezing temperature. Although Najewicz provides for a duct that runs from the freezer compartment to the thermoelectric icemaker, the cold air from the duct is used to remove heat from the thermoelectric icemaker. Najewicz has many problems that must be overcome in order to be practical including the removal of unfrozen water, rapid ice body formation, prolonged ice storage, etc. The present invention overcomes these problems.

A primary objective of the present invention is the provision of a bottom mount refrigerator having an ice dispenser in the door of the refrigerator compartment.

A further objective of the present invention is the provision of a bottom mount refrigerator having an icemaking compartment in the refrigerator compartment.

A further objective of the present invention is the provision of a bottom mount refrigerator having an icemaker in the refrigerator compartment.

Another objective of the present invention is the provision of an icemaker in the refrigerator compartment of a bottom mount refrigerator, with a cold air duct to provide air from the freezer compartment to the icemaker.

Still another objective of the present invention is the provision of an icemaker in the refrigerator compartment of a bottom mount refrigerator having efficient and timely icemaking capacity.

These and other objectives will become apparent from the following description of the invention.

SUMMARY OF THE INVENTION

The bottom mount refrigerator of the present invention has an icemaker within an insulated icemaking compartment in the refrigerator compartment. Cold air is supplied to the icemaking compartment from the freezer compartment via a cold air duct. A return air duct extends from the icemaking compartment to the freezer compartment. The icemaking compartment also includes a vent opening for venting air to the refrigerator compartment. A fan draws or forces air through the duct from the freezer compartment to the icemaking compartment. The temperature in the icemaking compartment is between 0° F. to 32° F., which is colder than the temperature of the refrigerator compartment, but not as cold as the freezer compartment. The icemaking compartment is preferably located in an upper corner of the refrigerator compartment. The door of the refrigerator compartment includes an ice dispenser to supply ice to a person without opening the refrigerator compartment door. The door may include an ice bin for storing ice from the icemaker.

DETAILED DESCRIPTION OF THE PREFERRED EMBODIMENT

Figure 1:
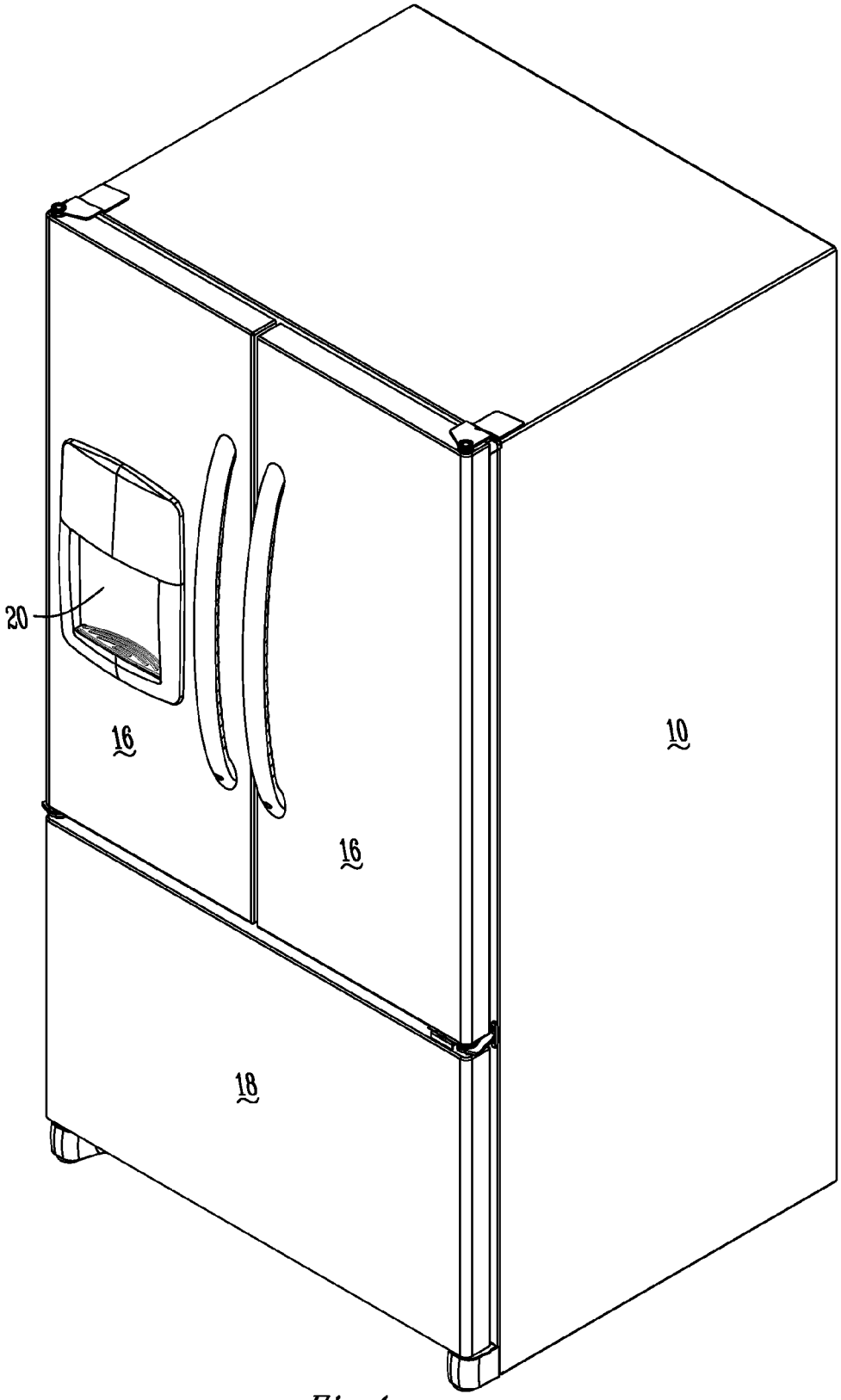
FIG. 1 is a perspective view of a bottom mount refrigerator according to the present invention.
Figure 2:
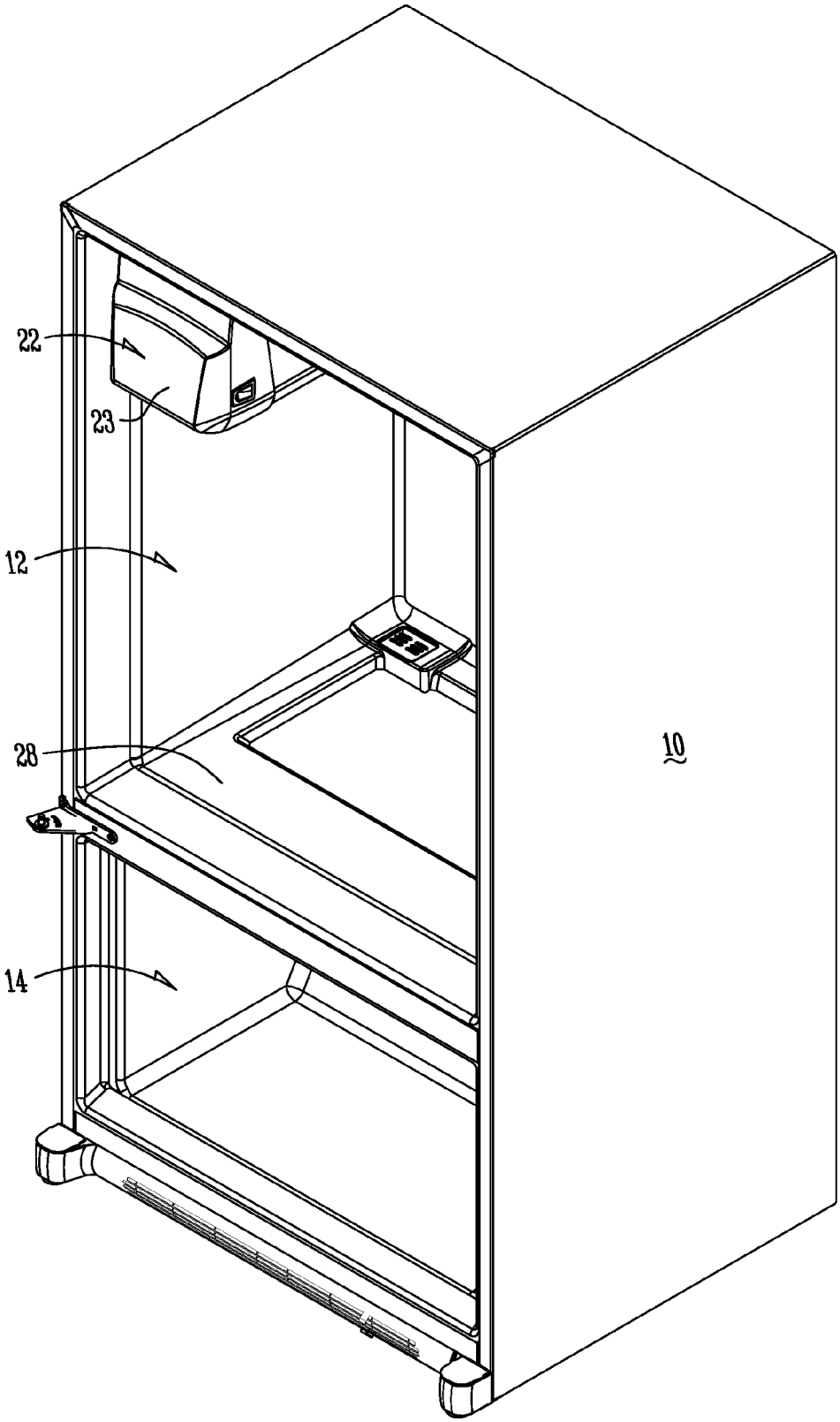
FIG. 2 is a perspective view of the bottom mount refrigerator having the doors removed.

A bottom mount refrigerator is generally designated in the drawings by the reference numeral 10. The refrigerator 10 includes a refrigerator or fresh food compartment 12 and a freezer compartment 14. Doors 16 are provided for the refrigerator compartment or fresh food compartment 12 and a door 18 is provided for the freezer compartment 14. One of the doors 16 includes an ice dispenser 20, which may also include a water dispenser.

An icemaking compartment or intermediate compartment 22 is provided in the refrigerator compartment 12. The icemaking compartment 22 is shown to be in one of the upper corners of the refrigerator compartment 12, but other locations are also within the scope of this invention. The icemaking compartment 22 has a front cover 23 that is insulated to prevent the cold air of the icemaking compartment 22 from passing into the refrigerator compartment and opening 21 is provided that mates with chute 19 of the ice dispenser 20. A seal may be provided between the opening 21 and chute 19 to prevent cold air from passing from the icemaking compartment to the refrigerator compartment 12. Additionally, the flipper door that operates by a solenoid may be placed at the opening 21 to prevent cold air from leaving the icemaking compartment 22 and entering into the refrigerator compartment. Preferably, the icemaking compartment 22 includes a conventional icemaker that forms ice in an environment that is below freezing. Other types of icemakers can be utilized.

The icemaking compartment 22 may be integrally formed adjacent the refrigerator compartment 12 during the liner forming process and insulation filling process. Alternatively, the icemaking compartment 22 may be made remote from the fresh food compartment and slid into the refrigerator compartment 12 by overhead rails (not shown) or other mounting.

The refrigerator 10 includes an evaporator 24 which cools the refrigerator compartment 12 and the freezer compartment 14. Normally, the refrigerator compartment 12 will be maintained between 34-40° F. and the freezer compartment 14 will be maintained at approximately 0° F. The icemaking compartment is maintained at a temperature of 32° F. or less in order to form ice, but is not as cold as the freezer compartment 14. The walls of the icemaking compartment are insulated to facilitate temperature control. Grates or air vents 26 are provided in the wall 28 between the refrigerator compartment 12 and the freezer compartment 14 to allow air circulation between the compartments.

Figure 5:
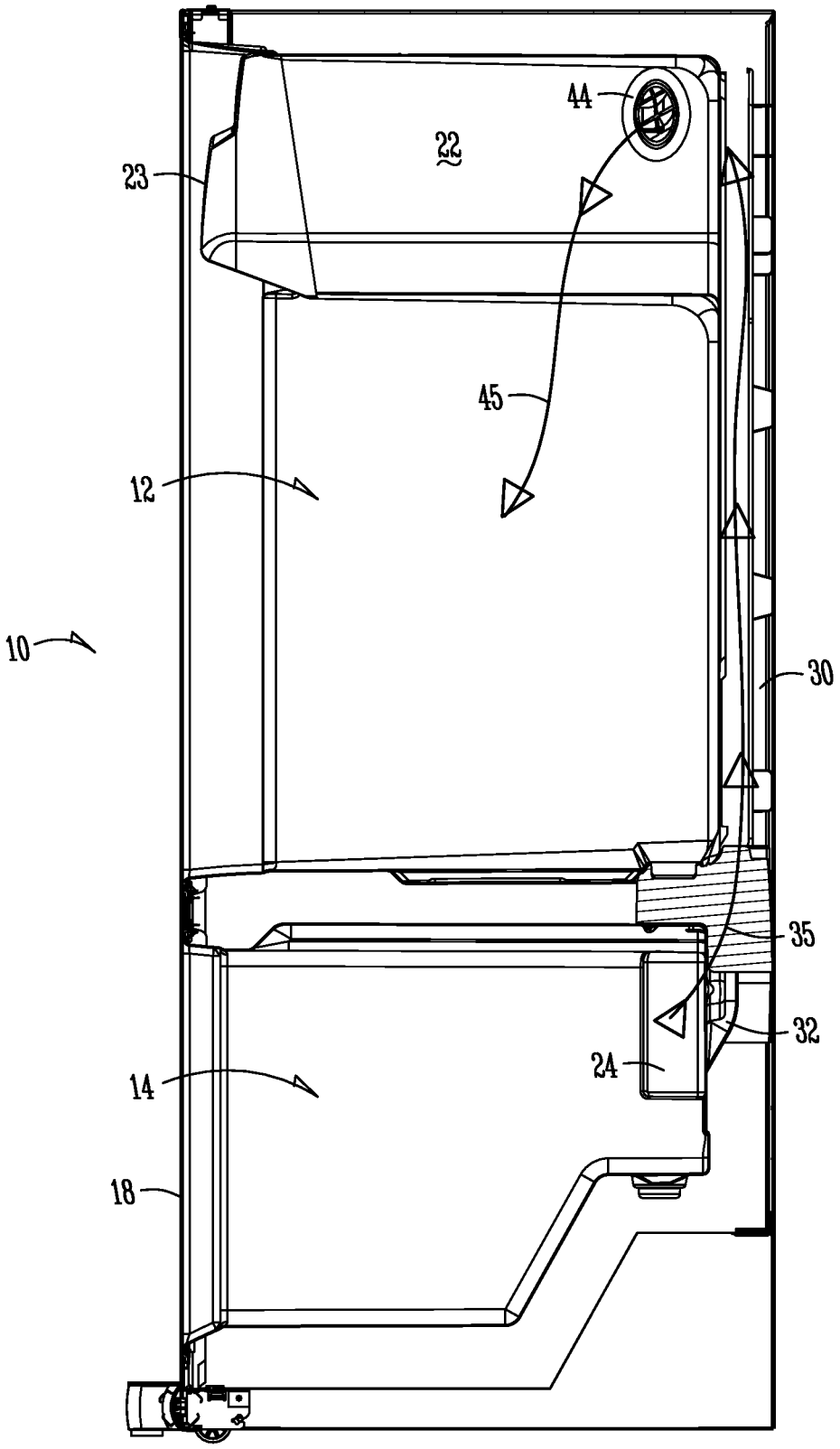
FIG. 5 is a sectional view taken along lines 5-5 of FIG. 4.

A cold air duct 30 extends between the freezer compartment 14 and the icemaking compartment 22. More particularly, the cold air duct 30 has a lower air inlet 32 within the freezer compartment 14 and an upper outlet end 34 connected to a fan 36 mounted on the back wall of the icemaker 22. The fan 36 draws cold air from the freezer compartment and forces the cold air into the icemaker 22 so as to facilitate icemaking. It is understood that the fan 36 may be located at the inlet end 32 of the cold air duct 30. The fan 36 controls the air flow from the freezer compartment 14 to the icemaking compartment 22 and may be a variable speed fan. The fan is actuated by conventional means. The cold air duct 30 preferably resides within the rear wall of the refrigerator 10, as seen in FIG. 5. The arrow 35 designates the air flow through the cold air duct 30.

Figure 6:
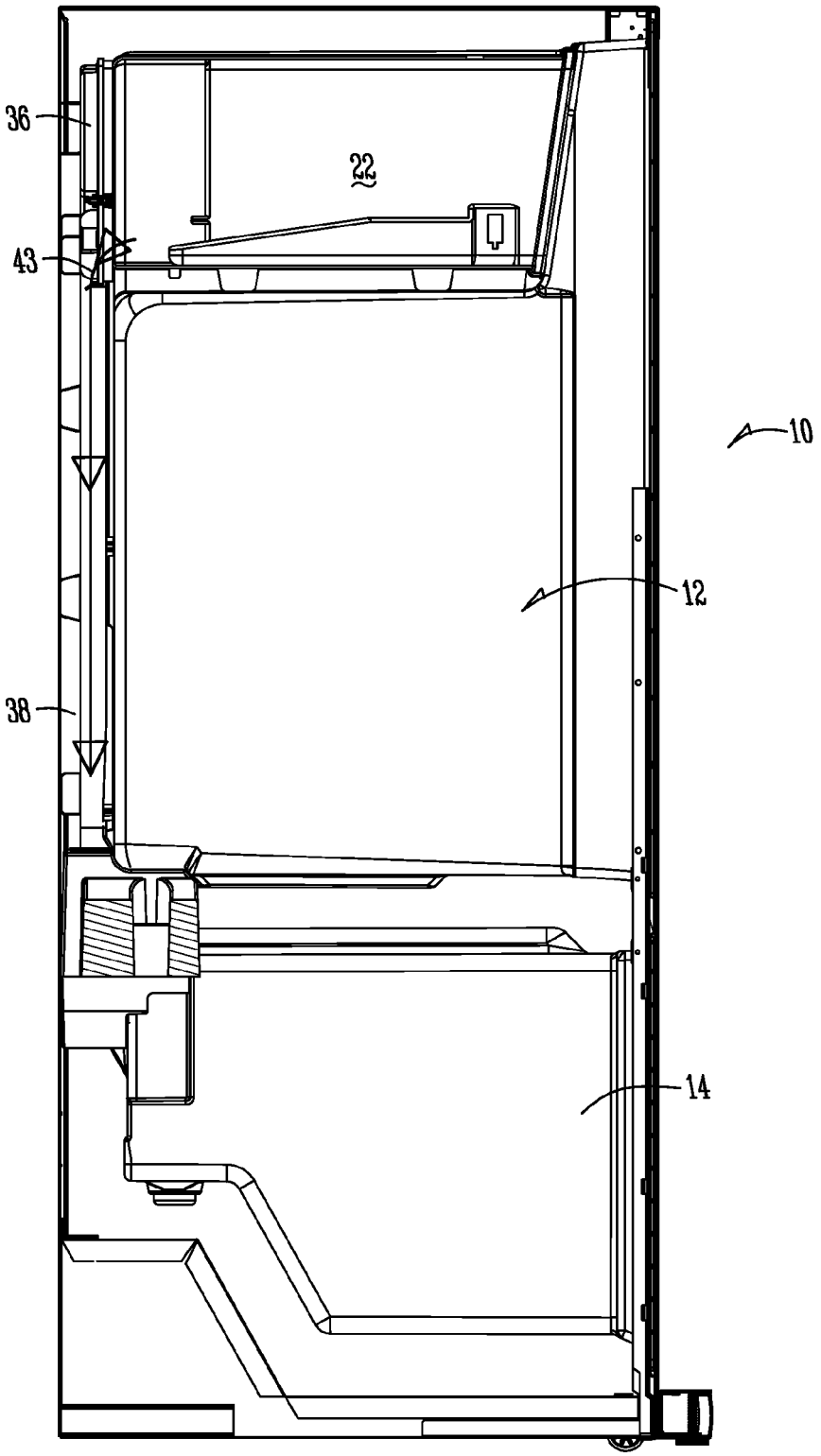
FIG. 6 is a sectional view taken along lines 6-6 of FIG. 4.

The refrigerator 10 also includes a return air duct 38 having an upper end 40 connected to the icemaker 22, and a lower end 42 terminating adjacent one of the air grates 26. Alternatively, the lower end 42 of the return air duct 38 may extend into the freezer compartment 14. Preferably, the return air duct 38 resides within the rear wall of the refrigerator 10, as seen in FIG. 6.

Figure 3:
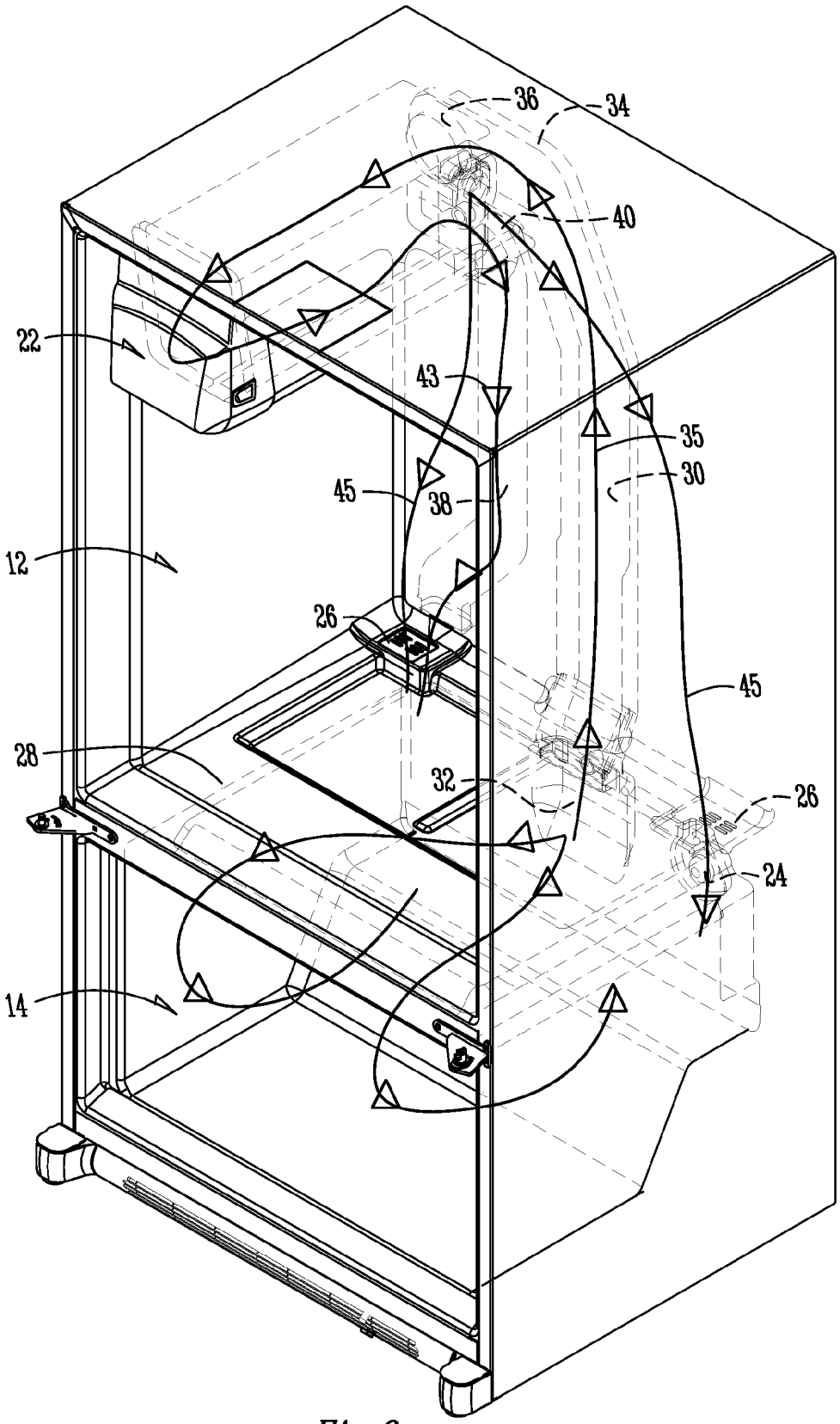
FIG. 3 is a view similar to FIG. 2 showing the cold air duct and return air duct for the icemaking compartment.

The icemaking compartment 22 also has an air vent for discharging air into the refrigerator compartment 14. Thus, a portion of the air from the icemaking compartment 22 is directed through the return air duct 38 to the freezer compartment 14, as indicated by arrow 43 in FIG. 3, and another portion of the icemaking compartment air is vented through the opening 44 into the refrigerator compartment 12, as indicated by arrows 45 in FIG. 3.

Figure 4:
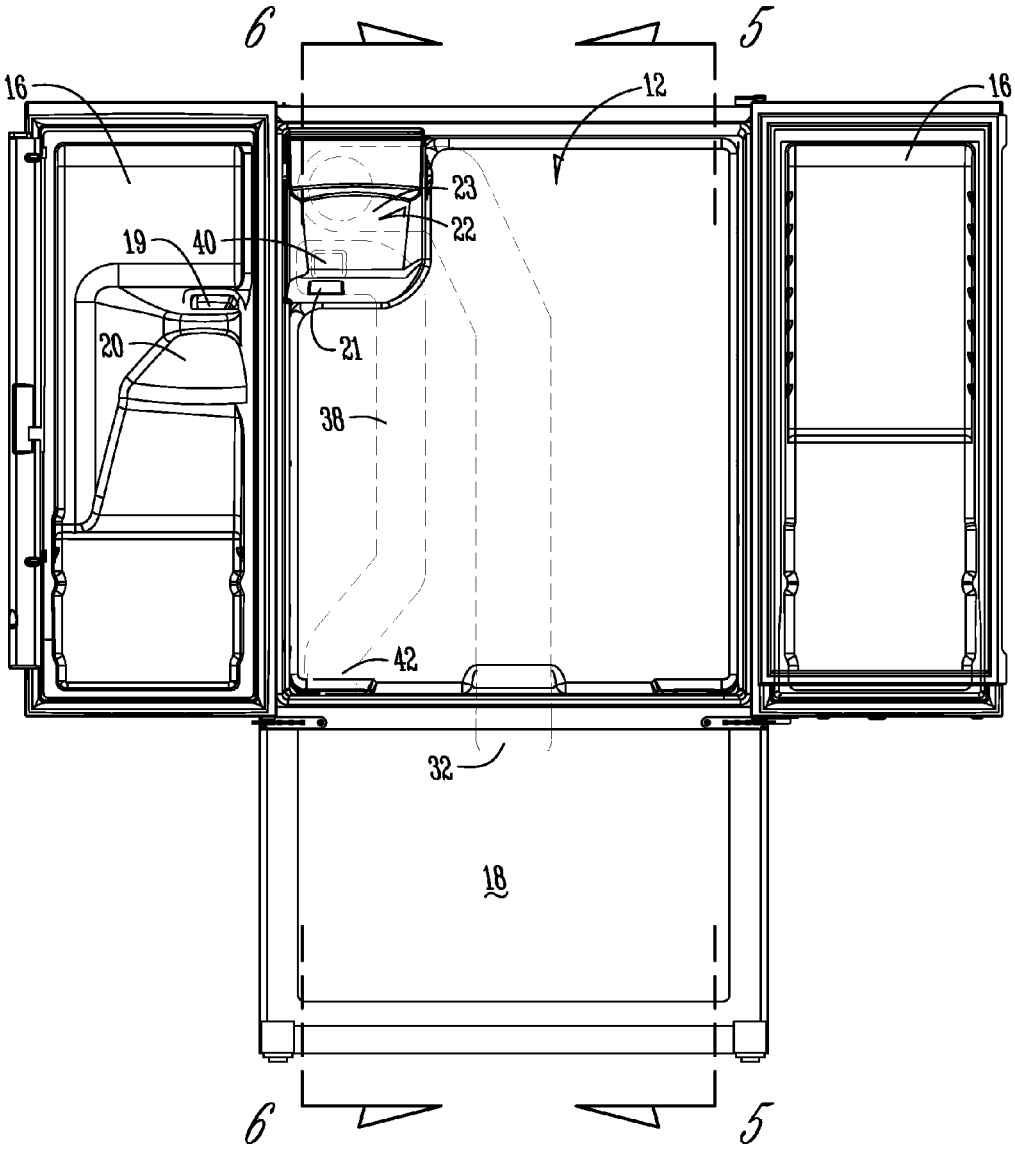
FIG. 4 is a front elevation view of the bottom mount refrigerator of the present invention with the doors open, and illustrating the cold air and return air ducts.

As seen in FIG. 4, the ice is discharged from the icemaker 22 in any conventional manner. Similarly, the ice dispenser 20 functions in a conventional manner.

Figure 7:
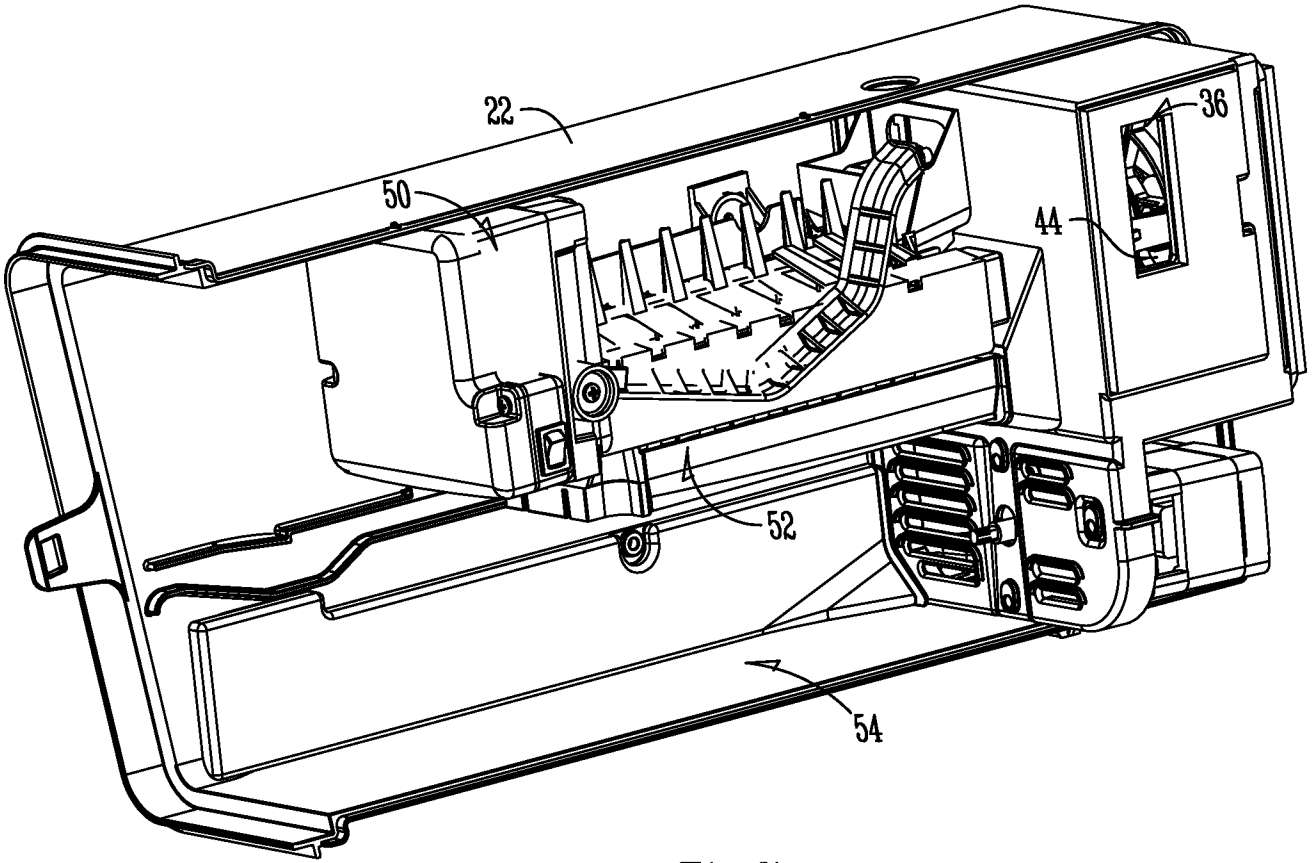
FIG. 7 is a perspective view of the icemaker positioned within the icemaking compartment.

As seen in FIG. 7, an icemaker 50 is positioned within the icemaking compartment 22 with the ice storage area 54 with auger (not shown) removed for clarity. The icemaker 50 is mounted to an impingement duct 52. The impingement duct receives freezer air coming from the freezer compartment through the cold air duct 30 and the fan assembly 36. The opening 44 vents air into the refrigerator compartment 12. The auger assembly (not shown) is provided beneath the icemaker 50 along with an ice storage bin with an insulated cover 23.

A control system is provided that utilizes the icemaking compartment 22, the cold air supply duct 30, the return air duct 38, the variable speed icemaking fan 36, icemaking impingement air duct 52, an icemaking compartment thermistor (not shown), an icemaking compartment electronic control damper, fresh food air return ducts 26, and a fresh food compartment thermistor (not shown). The above components are controlled by an algorithm that prioritizes the making of ice unless the fresh food temperature exceeds the set point temperature. This prioritization is achieved as follows:

i. When ice is a priority, the fresh food damper is closed and the fan runs at optimum speed. In this way, supply air from the freezer compartment 14 is discharged through the impingement air duct 52, through the ice storage area 54, and through the icemaking compartment return air duct 38. As a result of this air flow, ice is made at the highest rate.

ii. When the refrigerator compartment 12 is above set point, the electronic control damper opens and the fan runs at optimum speed. The supply air to the icemaking compartment is routed almost entirely into the fresh food compartment which forces the warmer air to return to the evaporator coil of the refrigerator. This achieves a rapid return to the fresh food set point after which the damper closes and the icemaking resumes.

iii. When the ice bin is full and the fresh food temperature is satisfied, the icemaking fan runs at minimum speed to produce energy consumption, reduce sound levels, and to minimize sublimation of ice.

The above control system permits precision control of both the icemaking compartment 22 and the refrigeration compartment 12 separately, yet minimizes the complexity and the number of component parts necessary to do so.

A thermoelectric unit (not shown) may replace the impingement duct 52 with some concessions. Preferably the thermoelectric unit would contour about the icemaker as it effectively pulls heat out of the water. Additionally, the thermoelectric unit would require a heat sink outside of the icemaking compartment 22 to dissipate heat. A careful balance is required between the voltage of the thermoelectric unit and the temperature of the refrigerator compartment 12 if the heat sink is in the refrigerator compartment 12. For example, the higher the voltage, the more heat will be generated that will be required to be removed from the refrigerator compartment 12. A portion of the heat generated by the thermoelectric unit may be removed by venting freezer compartment air to the thermoelectric unit.

Applicant's co-pending provisional application Ser. No. 60/613,241 filed Sep. 27, 2004 is hereby incorporated by reference in its entirety. This application and the provisional application both relate to a refrigerator with a bottom mount freezer and an icemaking compartment for making ice at a location remote from the freezer.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A bottom mount refrigerator, comprising:

a freezer compartment having a freezer door;

a fresh food compartment located over the freezer compartment and having a fresh food door with an ice dispenser;

an icemaking compartment located away from a mullion wall of the refrigerator having an air temperature 32° F. or less;

an icemaker in the icemaking compartment wherein ice is frozen in the ice maker through below freezing air;

a fan for moving air from the freezer compartment into the icemaking compartment;

a cold air duct extending between a source of below freezing air and the icemaking compartment to supply cold air to the icemaking compartment, wherein the cold air duct remains uninterrupted by opening of the fresh food door; and a return air duct extending between the icemaking compartment and the source of below freezing air.

2. The bottom mount refrigerator of claim 1 wherein the icemaking compartment includes an ice storage area.

3. The bottom mount refrigerator of claim 2 wherein the icemaker includes an ice mold positioned so that ice from the ice mold can be discharged into the storage area and dispensed by the ice dispenser.

4. The bottom mount refrigerator of claim 1 wherein the icemaking compartment is within the fresh food compartment.

5. The bottom mount refrigerator of claim 1 further comprising an air outlet in the icemaking compartment to vent air from the icemaking compartment to the fresh food compartment.

6. The bottom mount refrigerator of claim 1 wherein the fan is located adjacent the icemaker.

7. The bottom mount refrigerator of claim 5 wherein the icemaking compartment is located in an upper corner of the fresh food compartment.

8. The bottom mount refrigerator of claim 6 further comprising an air outlet in the icemaking compartment to vent air to the fresh food compartment.

9. A refrigerator, comprising:

a freezer compartment having a freezer door;

a fresh food compartment having a pair of fresh food doors;

an insulated intermediate temperature compartment located behind one of the pair of fresh food doors and away from a mullion wall having an air temperature between 0-32° F.;

a cold air duct in a wall of the refrigerator extending between the a source of below freezing air and the intermediate compartment;

a fan for moving air through the cold air duct from the freezer compartment to the intermediate compartment; and a return air duct spaced apart from the fresh food door and extending between the intermediate compartment and the freezer compartment, wherein the cold air duct remains uninterrupted by opening of the fresh food door.

10. The refrigerator of claim 9 further comprising an icemaker in the intermediate compartment wherein ice is formed in the icemaker through below freezing air.

11. The refrigerator of claim 10 further comprising an ice dispenser in a fresh food door positioned so that ice from the intermediate temperature compartment can be dispensed.

12. The refrigerator of claim 11 further comprising an ice storage area within a fresh food door in engagement with the intermediate compartment when the fresh food door is closed.

13. The refrigerator of claim 9 wherein the intermediate compartment has an ice storage area.

14. A bottom mount refrigerator, comprising:

a freezer compartment;

a freezer compartment door providing access to the freezer compartment;

a fresh food compartment located over the freezer compartment;

a fresh food compartment door providing access to the fresh food compartment and having an ice dispenser;

an icemaking compartment spaced from a mullion wall separating the freezer compartment and fresh food compartment;

an icemaker with an ice mold in the icemaking compartment wherein ice is made in the ice mold through below freezing air;

a cold air duct extending between the freezer compartment and the icemaking compartment to supply cold air from a source of below freezing air to the icemaker, wherein the cold air duct remains uninterrupted by opening of the fresh food compartment door;

a fan for moving air from over the ice mold; and a return air duct extending between the icemaker and the source of below freezing air.

15. The bottom mount refrigerator of claim 14 wherein the fan is located adjacent the icemaker.

16. The bottom mount refrigerator of claim 14 wherein the icemaking compartment is located in an upper corner of the fresh food compartment.

17. The bottom mount refrigerator of claim 14 further comprising an air outlet in the icemaking compartment to vent air to the fresh food compartment.

18. The bottom mount refrigerator of claim 14 wherein the icemaking compartment has a temperature maintained between 0-32° F.

19. The bottom mount refrigerator of claim 14 wherein the cold air duct is at least partially disposed within an insulated wall of the refrigerator.

* * * * *